US006948424B2

(12) United States Patent
Schroeder et al.

(10) Patent No.: US 6,948,424 B2
(45) Date of Patent: Sep. 27, 2005

(54) MATERIAL COMPACTION APPARATUS

(75) Inventors: Duane G. Schroeder, New Hope, MN (US); Raymond J. Koski, Andover, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 92 days.

(21) Appl. No.: 10/138,190

(22) Filed: May 1, 2002

(65) Prior Publication Data

US 2003/0024861 A1 Feb. 6, 2003

Related U.S. Application Data

(60) Provisional application No. 60/316,145, filed on Aug. 30, 2001, and provisional application No. 60/287,820, filed on May 1, 2001.

(51) Int. Cl.[7] ..... B30B 9/02
(52) U.S. Cl. ..... 100/37; 100/41
(58) Field of Search ..... 100/110, 116, 100/35, 37, 41, 45, 126, 127, 138–143, 177–179, 185, 186, 189, 215, 226, 229 R, 232, 233, 242, 244, 269.18, 269.19, 337, 117, 903, 906, 909, 191

(56) References Cited

U.S. PATENT DOCUMENTS

| | | | | | |
|---|---|---|---|---|---|
| 680,841 | A | * | 8/1901 | Chapman | 100/140 |
| 2,332,170 | A | | 10/1943 | Sapp | |
| 2,596,872 | A | * | 5/1952 | Skromme | 100/191 |
| 3,070,006 | A | * | 12/1962 | Raney et al. | 100/192 |
| 3,090,182 | A | * | 5/1963 | Johnson et al. | 56/1 |
| 3,350,999 | A | * | 11/1967 | Morse | 100/43 |
| 3,765,321 | A | | 10/1973 | Newell | |
| 3,866,529 | A | | 2/1975 | Holman | |
| 3,980,014 | A | | 9/1976 | McEwen et al. | 100/127 |
| 4,037,528 | A | | 7/1977 | White et al. | |
| 4,059,049 | A | * | 11/1977 | Tillgren | 100/41 |
| 4,080,889 | A | | 3/1978 | Shiloni | |
| 4,100,849 | A | * | 7/1978 | Pelton | 100/41 |
| 4,162,603 | A | * | 7/1979 | Stromberg | 53/438 |
| 4,557,190 | A | | 12/1985 | Vezzani | 100/98 |
| 4,594,942 | A | * | 6/1986 | Denneboom | 100/137 |
| 4,603,909 | A | | 8/1986 | Le Jeune | |
| 4,897,194 | A | * | 1/1990 | Olson | 210/359 |
| 5,173,196 | A | * | 12/1992 | Macrae | 210/808 |
| 5,322,009 | A | * | 6/1994 | Retrum | 100/96 |
| 5,365,838 | A | * | 11/1994 | Valentini | 100/112 |
| 5,391,069 | A | | 2/1995 | Bendzick | 425/78 |
| 5,461,975 | A | | 10/1995 | Driggs | |
| 5,542,348 | A | | 8/1996 | Bendzick | |
| 5,662,036 | A | | 9/1997 | Daniel | 100/209 |
| 5,664,491 | A | | 9/1997 | Maki et al. | |
| 5,664,492 | A | | 9/1997 | Bendzick | 100/45 |
| 5,694,742 | A | | 12/1997 | Elliott | |
| 5,735,197 | A | * | 4/1998 | Kleine | 100/127 |
| 5,832,815 | A | * | 11/1998 | Bollegraaf | 100/42 |
| 6,152,027 | A | | 11/2000 | Segura | |
| 6,272,981 | B1 | | 8/2001 | Murata et al. | 100/50 |
| 6,349,638 | B1 | | 2/2002 | Thompson | 100/218 |

* cited by examiner

*Primary Examiner*—Derris H. Banks
*Assistant Examiner*—Jimmy T Nguyen
(74) *Attorney, Agent, or Firm*—Patterson, Thuente, Skaar & Christensen, P.A.

(57) ABSTRACT

The material compactor in accordance with the present invention generally includes a feed apparatus, a preliminary compaction apparatus, and a final compaction apparatus. The final compaction apparatus generally includes a compaction chamber having an adjustably taperable choke tube. The area of the inner cavity of the final compaction chamber can be tapered to become measurably smaller or larger at the discharge or expelling end. Consequently, compacting movement of the material within the compaction chamber and through the tapered choke tube significantly subjects the material to restrictive compacting pressure which in turn compacts the material and performs liquid separation with each operationally continuous movement through the final compaction apparatus.

3 Claims, 10 Drawing Sheets

MATERIAL COMPACTION APPARATUS

RELATED APPLICATIONS

The applicant hereby claims benefit of the contents and filing date accorded to U.S. Provisional Patent Application filed May 1, 2001, entitled "Choke Tube Material Compaction Apparatus" and assigned Ser. No. 60/287,820, and Provisional Patent Application filed Aug. 30, 2001, entitled "Material Compaction Apparatus" and assigned Ser. No. 60/316,145, with both of said applications being incorporated herein by reference.

FIELD OF THE INVENTION

This invention relates to material compaction and liquid separation. More particularly, this invention relates to the compaction of various materials, and the removal of various liquids from in and around those materials by pushing the materials and liquid through an adjustably taperable chamber.

BACKGROUND OF THE INVENTION

In the manufacturing process, metals and other materials can be manipulated through various machining processes. During these processes, liquids are often applied to serve as lubricants and coolants. Depending on the material composition and the specific manufacturing needs, the liquid can be quite costly. The process inevitably results in waste consisting of material and liquid. Any material or liquid that could be saved and reused, or properly disposed of, could provide significant savings.

Costs associated with the disposal or recycling of the material waste are increased if liquid remains below or above the surface of the material following the manufacturing process. Liquid used during a specific process may leave a material unusable until that liquid has been nearly completely separated from the material. Further, an efficient and thorough separation of the manufacturing material and the liquid can assure that material and liquid reuse is maximized. This in turn makes it more likely that reusable material or liquid is not being disposed of with the unusable or unwanted waste.

Further, various governmental laws and regulations require proper disposal and removal of many defined materials and liquids. If these laws and regulations are not specifically followed, costly fines and other penalties may be imposed. An efficient separation and compaction process facilitates conformity with these requirements.

Present material compacting apparati are so-called briqueting machines that carry out numerous steps to create a block of compacted material. The machines compact relatively comminuted shavings and scrap. The key to these machines is the repetitive hydraulic or mechanical steps that are performed on each block of material against a resistive gate.

These machines focus the compaction process on this repetitive gate system. Material waste is fed into a compaction chamber. This compaction chamber generally consists of a ramming device and a gate, at opposing ends. The material waste is fed into the chamber so that it rests in between the ramming device and the gate. One or more compaction stages are performed on the material. Generally, an initial compaction stage advances the ramming device under low pressure, loosely compacting the material under pressure against the gate. This ramming device will be driven by either hydraulic or mechanical means. The mechanical means can function in the same manner as a mechanical device (i.e., punch press), or other like devices, for repeatedly advancing the ramming device forward, thus pressing the material against the gate.

Following initial compression, a second compaction stage generally occurs where the loosely compacted waste is subject to high pressure from the ramming device against the gate. Desired compression levels and ramming steps and/or energy are directly related, and as such, a highly compacted mass of material requires significant ramming steps and/or exerted energy on the material. After compaction is complete the machine must engage in several motions or steps just to eject the material block and to set up for the next grouping of material. The ramming device must retract and the gate must be raised or relocated from its end position in the compaction chamber in order to allow for the ejection of the material. The ramming device is then operated at low pressure in a forward direction to discharge the compacted material waste from the compaction chamber. Upon discharge of the block, the ramming device and the gate must move back to their original positions in the compaction chamber. This repetitive process must be performed for each individual grouping of material loaded into the compaction chamber.

There is an innate inefficiency embodied within the processes utilized by these conventional compaction machines. Wasted motion and energy is inevitable within any of these systems that rely on a gate system. A continuous compaction process is impossible to achieve. The wasted movement of the ramming device within a gate system means that such a device will unnecessarily increase manufacturing time and energy costs. Any attempt to reduce the processes or ramming steps will inevitably result in a reduction in the level of compaction and liquid separation.

Even when conventionally acceptable ramming steps and exerted energy levels are utilized, material compaction and liquid separation are not optimal. While the current machines do significantly compact and remove liquid from the surfaces and interior of the material waste, there is room for sizeable improvement. Consequently, a more efficient and effective machine is needed to minimize costs and to maximize material compaction and liquid separation.

SUMMARY OF THE INVENTION

The material compaction system and methods of the present invention substantially address and solve the innate problems of conventional compaction machines and methods. The compaction system in accordance with the present invention provides highly efficient and effective compaction that substantially minimizes costs associated with wasted manufacturing steps, while at the same time substantially maximizes material compaction and liquid separation.

The material compactor in accordance with the present invention generally includes a feed apparatus, a preliminary compaction apparatus, and a final compaction apparatus. The final compaction apparatus generally includes a compaction chamber having an adjustably taperable choke tube. The area of the inner cavity of the final compaction chamber can be tapered to become measurably smaller or larger at the discharge or expelling end. Consequently, compacting movement of the material within the compaction chamber and through the choke tube significantly subjects the material to compacting restriction, or funnelized pressure in those cases where there is a reducing taper, which in turn compacts the material and performs liquid separation with each operationally continuous movement through the final compaction apparatus. Even if there is no taper, or if there is an increase in the area at the discharge port, restriction occurs on the material within the limited confines of the chamber and compaction results.

In one embodiment, area adjustment at the expelling end or discharging port of the final compaction apparatus is achieved through the use of a generally rectangular "choke tube." The rectangular choke tube is generally constructed of multiple adjustable rectangular plates. These rectangular plates permit angular/tapered adjustments to the choke tube to advantageously control restriction, or funnelizing pressure, through to the discharge port. The choke tube is open at the discharge port and compacted material may be continuously discharged out of this port following rigorous and repeated compaction.

In the embodiment having this rectangular choke tube, a first compaction stage is provided with the use of the feed apparatus, such as an auger. This auger provides for a beneficial initial light compaction of the material before directing the material into the preliminary compaction apparatus. The force-exerting movement of the material into and through the auger provides for this initial light compaction. The auger may be a so-called "pig tail" auger, supported at its driven end and merely being rotatably disposed in an auger tube or feed channel at its discharge end.

Generally, two ramming devices are included in what will generally be referred to as the rectangular choke tube embodiment of the present invention. A preliminary compaction ram or device is operably aligned for movement (generally vertical) and compaction within in a preliminary compaction chamber of the preliminary compaction apparatus. A final compaction ram or device is operably aligned for movement (generally horizontal) and compaction within a final compaction chamber of the final compaction apparatus. Timing can be such that the advancing and retracting movement of the preliminary ram is substantially in timed and positional opposition with the advancing and retracting movement of the final ram. The preliminary ram provides yet another compaction stage (in addition to the initial compaction effect of the feed apparatus or auger) before the chips reach the final compaction apparatus. In addition, or in replacement of the initial compaction of the feed channel or auger tube, a compaction door system can be employed to provide a level of compaction prior to the preliminary compaction of the preliminary ramming device.

In another embodiment, generally referred to as the cylindrical choke tube embodiment, the compactor can comprise a feed apparatus, a preliminary compaction apparatus, and a final compaction apparatus as well. However, a unique distinction between the cylindrical and rectangular embodiment is in the function and design of the final compaction chamber, and the choke tube system in particular. The choke tube of the cylindrical embodiment generally comprises a plurality of axial slots, a choke tube ring, and a plurality of angled surface wedges. Adjustments of the choke tube ring along the angled surface wedges fixed to the final compaction chamber creates a restriction or even funnelized pressure at the discharge port region of the final compaction chamber. Adjustment to the location of the ring can serves to adjust the taper at the discharge port which in turn varies the internal area of the inner cavity of the final compaction chamber.

With each embodiment, there is a nearly continuous feeding action of the compactable material through the machine and, particularly, through the final compaction apparatus and out the discharging port of the corresponding choke tube. The process of feeding the material through the final compaction apparatus is only momentarily halted while a new grouping of material is compacted in the preliminary compaction apparatus.

DETAILED DESCRIPTION OF THE DRAWINGS

Rectangular Embodiment

Figure 1:
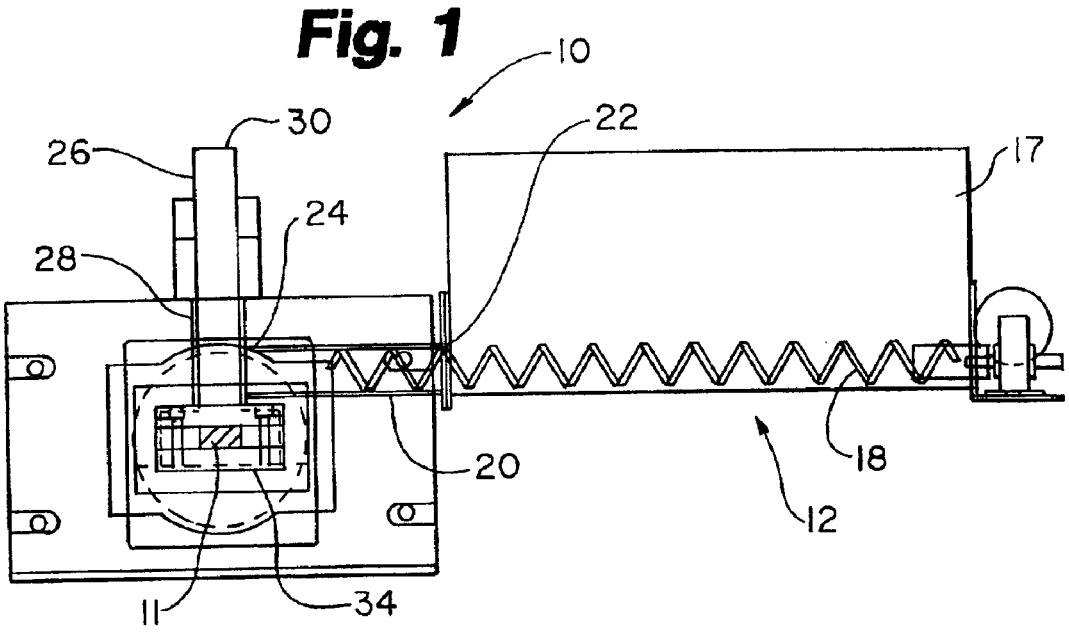
FIG. 1 is a front view of a material compaction apparatus in accordance with an embodiment of the present invention.
Figure 4:
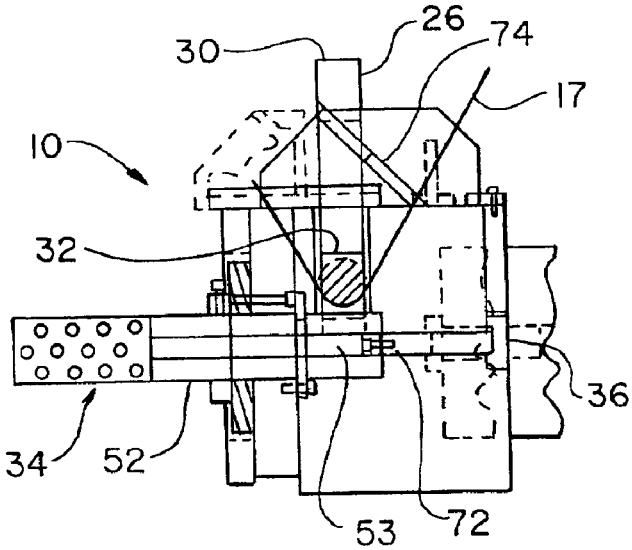
FIG. 4 is a side view of a portion of a material compaction apparatus in accordance with an embodiment of the present invention.

Referring to FIGS. 1–5, a rectangular embodiment of a material compactor 10 in accordance with the present invention is shown. This rectangular material compactor 10 generally comprises a feed apparatus 12, a preliminary compaction apparatus 14, and a final compaction apparatus 16. In relevant figures, certain dashed lines are included to demonstrate the potential movement (i.e., the start and finishing positions) for corresponding movable components.

The feed apparatus 12 generally comprises a bin 17, an auger 18, and a feed channel or auger tube 20. The feed channel 20 is in communication with the bin 17 and generally receives at least a portion of the auger 18. The auger 18 can be rotationally driven from at least one end by a motor and transmission, in forward and reverse. Various auger feeding devices known to one skilled in the art are envisioned for implementation with the compactor of the present invention. The auger 18 extends from the bin 17 into the feed channel 20. The inner diameter of the feed channel 20 is some size larger than the outer diameter of the rotating auger 18 so that rotation of the auger 18 is available for the portion of the auger 18 received within the channel 20. The feed channel is in communication with, and opens into, the preliminary compaction apparatus 14 at an end portion of the channel distal the bin 17. Further, the feed channel 20 can end at one section with a coupling 19 that permits modular connection with other couplings to permit variable connectability to promote flexibility in positional configurations for the feed apparatus.

The preliminary compaction apparatus 14 generally comprises a preliminary ramming device 26 and a preliminary compaction chamber 28. The ramming device 26 can comprise a ram driving means 30 and a ramming portion 32, wherein the driving means 30 drives the ramming portion 32 in and out of the preliminary compaction chamber 28 during operation. The preliminary ramming device 26 in a preferred configuration is vertically movable in and out of an inner cavity 31 of the preliminary compaction chamber 28 and is perpendicular in orientation to the generally horizontal feed channel 20. However, in alternative embodiments, the ramming device can be horizontally oriented, the feed channel can be substantially vertical, or some angular variation thereof can be implemented. Those skilled in the art will understand the driving means 30 to be advanced by hydraulic, pneumatic, mechanical, or means of the like. However, a vertically driven mechanically driven (i.e., a punch press or like device) ram is generally preferred for timing with the compaction of the final compaction apparatus 16.

Figure 5:
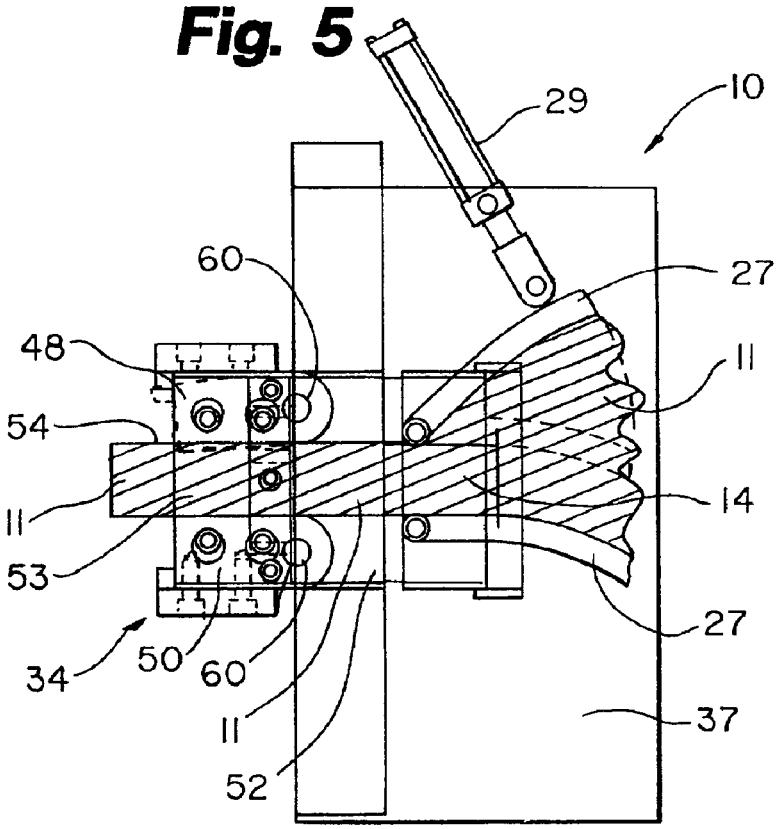
FIG. 5 is a top view of a portion of a material compaction apparatus in accordance with an embodiment of the present invention.
Figure 9:
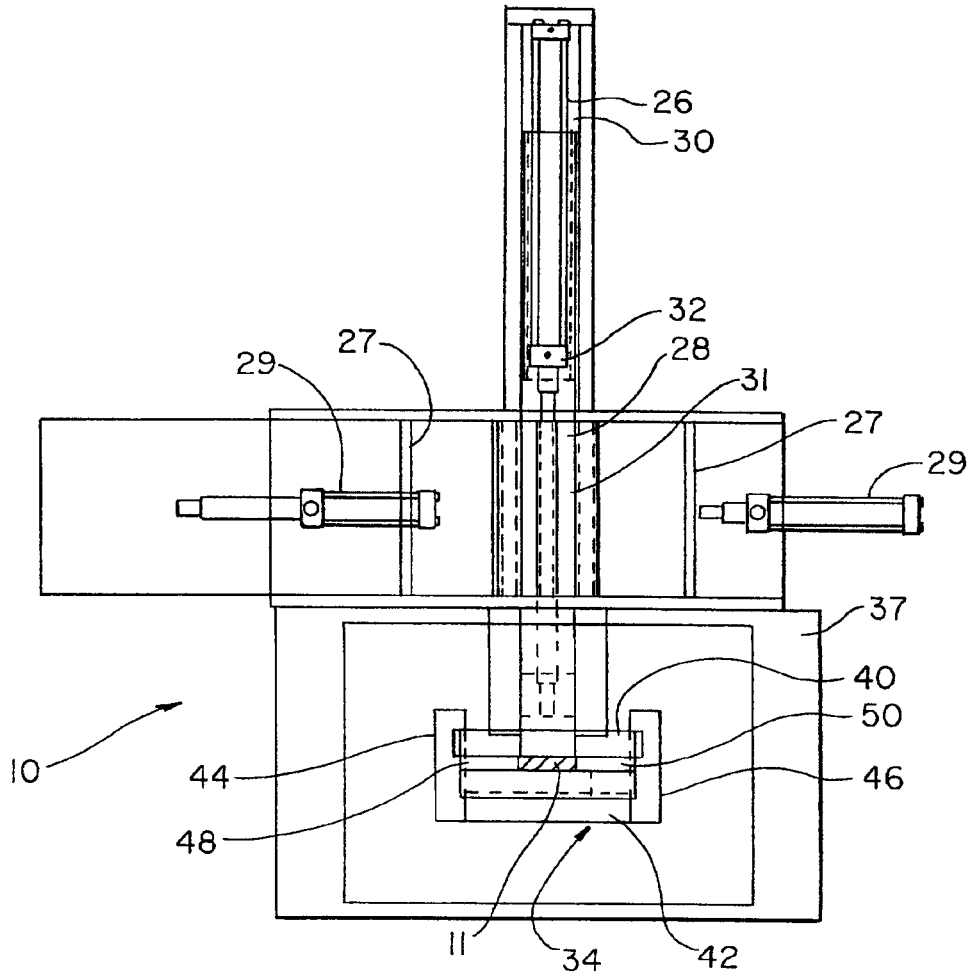
FIG. 9 is a top view of a portion of a material compaction apparatus in accordance with an embodiment of the present invention.

In alternative embodiments of the preliminary compaction apparatus 14, at least one preliminary compaction door 27 can be included at the sides of the preliminary compaction chamber 28, as shown in FIGS. 5 and 9. The material feed provided for by the rotating auger 18 generally terminates into an opening of the inner cavity 31. In addition, material 11 can just be dropped into the chamber 28 or fed by other means. The at least one door 27 is capable of radial movement and can be angled away from the inner cavity 31 of the chamber 28 in its start position prior to initiating any compaction on the material 11. Once the at least one door 27 is activated to move inward, generally radially, it will begin to compact material. The preliminary compaction chamber 28 is generally rectangular in shape at the point when the door or doors 27 are in their stop position following the compaction imposed by the inward motion. However, it is envisioned that doors having arcuate portions (such as is shown in FIG. 5) can be utilized, such that measurable angles can influence the shape of the preliminary chamber 28 and cavity 31 upon closing of the at least one door 27. At least one door 27 is connected to a preliminary driving device 29 for advancing and retracting the door 27 from the start position to the stop position, with the stop position being substantially in line with the rectangular shape of the cavity 31 of the preliminary compaction chamber 28. Those skilled in the art will understand the at least one driving device 29 to embody hydraulic, pneumatic, and means of the like. For instance, in one embodiment, one door 27 will be stationary and the other door 27 will angularly advance and retract hydraulically by the driving device 29 to perform a level of compaction on the subject material 11 prior to the compaction performed by the preliminary ramming device 26. In addition, substantially non-arcuate doors and/or substantially linear door movement can be implemented for alternative configurations of the movable doors 27. For instance, the doors 27 could start in a substantially parallel configuration to each other such that advancement inward toward the cavity 31 compacts the material 11 within the preliminary compaction chamber 28.

Figure 2:
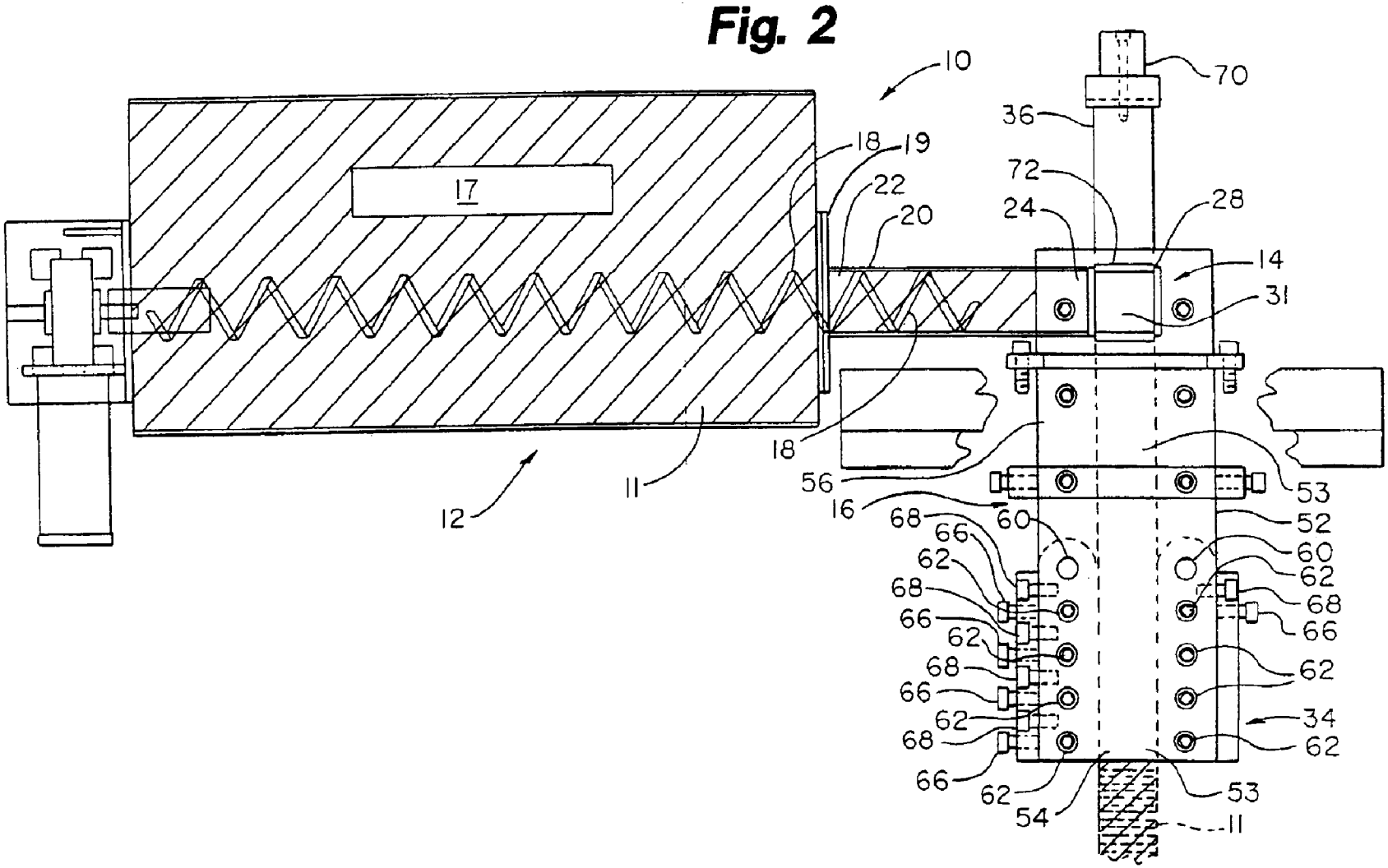
FIG. 2 is a top view of a material compaction apparatus in accordance with an embodiment of the present invention.
Figure 3:
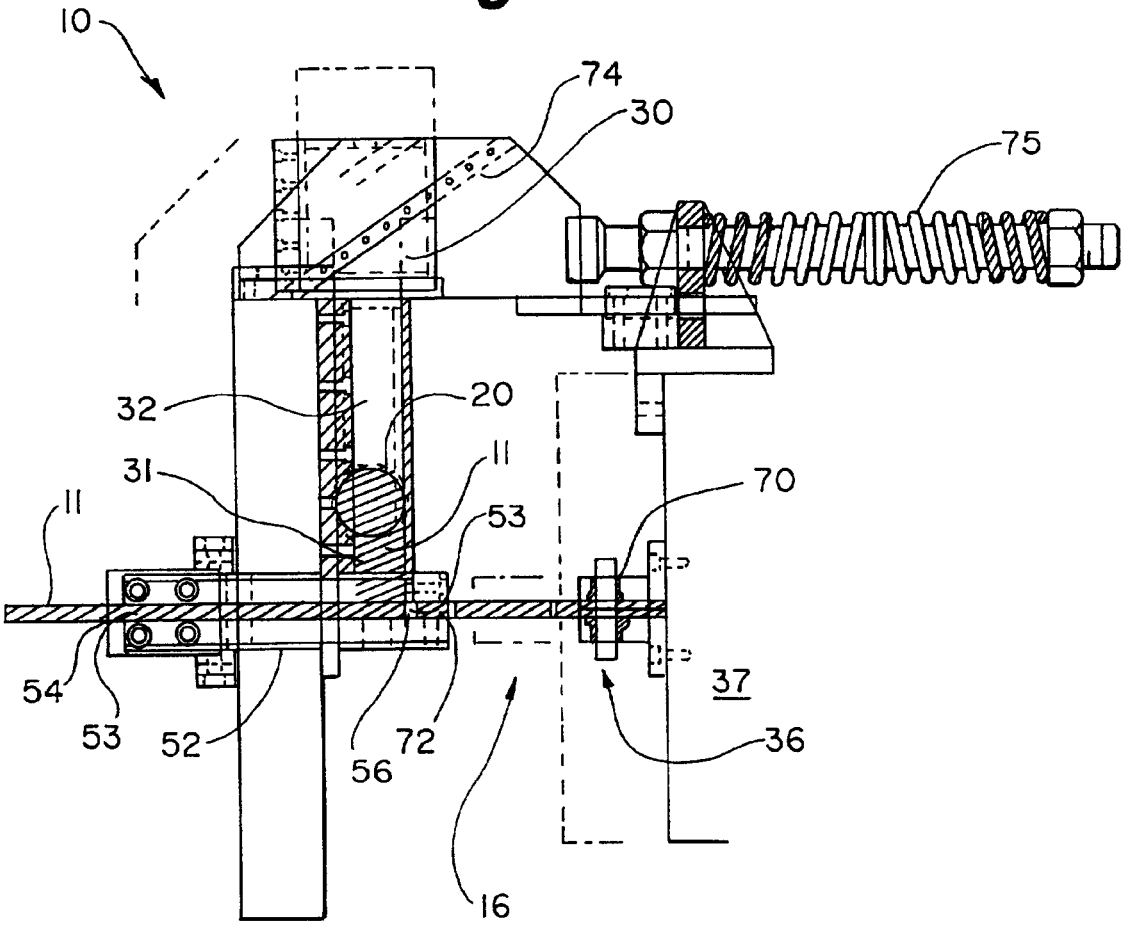
FIG. 3 is a side view of a portion of a material compaction apparatus in accordance with an embodiment of the present invention.

Referring primarily to FIGS. 2–3, the final compaction apparatus 16 comprises a final ramming device 36, and a final compaction chamber 52. The ramming device 36 is oriented for axial movement along the interior cavity 53 of the final compaction chamber 52. Preferably, this movement will be along a substantially horizontal plane, but the compactor could be configured such that the ramming device travels along a vertical plane with the compaction chamber 52. This ramming device 36 comprises a driving means 70 for advancing a ramming portion 72 into the final compaction chamber 52. Those skilled in the art will understand the driving means 70 to include hydraulic, pneumatic, mechanically driven technology, and the like. For one mechanical embodiment of the present invention, the driving means 70 can comprise mechanically driven technology. Depending on the desired speed, manufacturing and energy costs, and efficiency goals, various rated machines and machines can be used.

Figure 6:
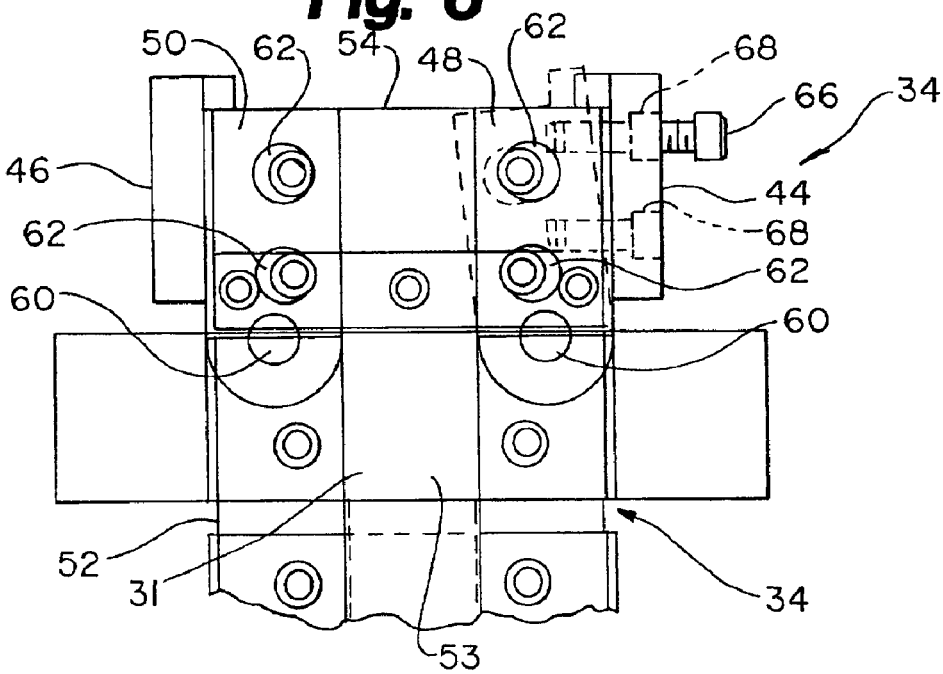
FIG. 6 is a top view of a choke tube in accordance with an embodiment of the present invention.
Figure 7:
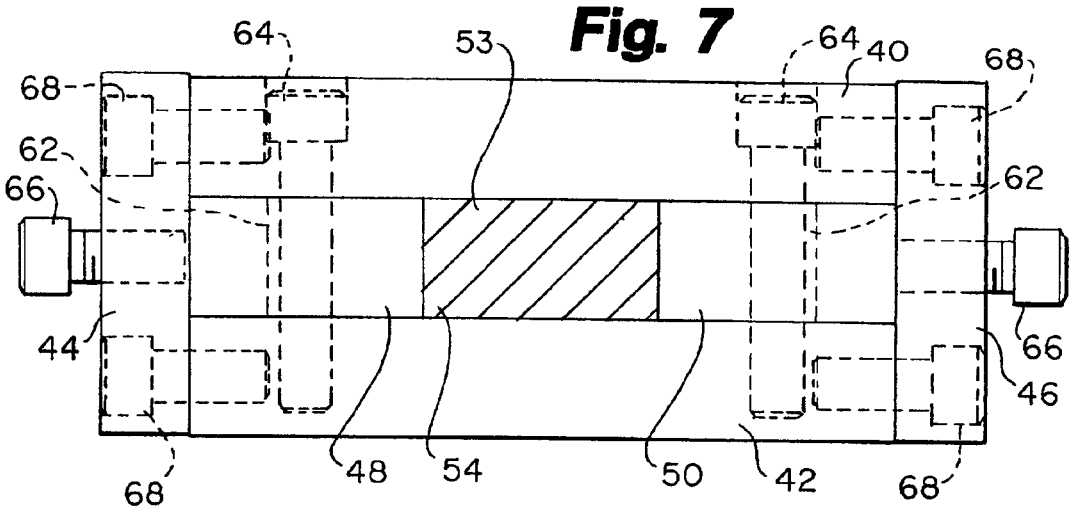
FIG. 7 is a front view of a choke tube in accordance with an embodiment of the present invention.

As best show in FIGS. 6–7, an end region of the final compaction chamber 52 includes a choke tube 34. The choke tube 34 generally includes a top plate 40, a bottom plate 42, a first side plate 44, a second side plate 46, a first choke plate 48, and a second choke plate 50. The positional configuration of these plates forms the generally rectangular inner cavity 53 or channel of the final compaction chamber 52 at the choke tube 34. In a preferred configuration, the inner cavity 53 at the choke tube 34 is defined horizontally by the inner boundaries of the spaced choke plates 48, 50 and vertically by the inner boundaries of the spaced plates 40, 42. A plurality of oversized apertures 62 intersect the respective proximate top and bottom plates 40, 42 and choke plates 48, 50 such that substantial axial alignment of the respective apertures 62 provides a bore for receiving a corresponding one of a plurality of first fasteners 64. All fasteners described herein can be a known bolt, pin, or screw (i.e., socket head cap screws). The first fasteners 64 can secure the generally horizontal plates 40, 42 with the choke plates 48, 50. However, the oversized apertures 62 are some size larger in diameter than the outside diameter of the received portion of the fasteners 64 through the choke plates 48, 50 to permit for rotational adjustment of the choke plates 48, 50 around a pivot point/pin 60. In addition, to facilitate rotation of the choke plates 48, 50, the choke plates 48, 50 can be made some measurable size thinner at the region proximate the choke tube 34 such that pivoting at the pivot pin 60 is not restricted by frictional engagement of the choke plates 48, 50 against the top or bottom plates 40, 42. Further, to provide a small gap between the plates 40, 42 and the choke plates 48, 50, bushings can be inserted within the oversized apertures 62. The top plate 40 can rest upon these bushings so that a gap is provided. In addition, the bushings can provide for a start and stop position for the choke plates 48, 50 rotating in toward the inner cavity 53. To enhance liquid separation, a plurality of grooves, at various preselected angles, can be provided for in the surfaces of the choke plates 48, 50 such that liquid can be channeled into and/or away from the inner cavity 53 of the chamber 52.

The side plates 44, 46 are abuttably secured against the respective proximate top and bottom plates 40, 42 and choke plates 48, 50 by a plurality of second fasteners 68. The second fasteners 68 intersect the side plates 44, 46 and continue some distance into the respective top and bottom plates 40, 42 to provide adjustable abuttable securement. A plurality of choke plate fasteners 66 pass through the side plates 44, 46 proximate the mid-point of the generally vertical cross-section of the side plates 44, 46. In one configuration, the choke plate fasteners 66 completely pass through the side plates 44, 46 and abut the outside surface of the choke plates 48, 50, without actually penetrating the choke plates 48, 50. As such, adjustments of the choke plate fasteners 66 provides for a corresponding adjustment of the abutted choke plate 48, 50. This adjustment to the positioning or angle of the choke plates 48, 50 is made possible as a result of the oversized apertures 62 through the choke plates 48, 50. Rotational motion at the pivot points 60 of the respective choke plates 48, 50 is not impeded by the presence of the fasteners 64. It will be understood that other methods of adjusting the angles of the choke plates 48, 50 can be implemented without deviating from the spirit and scope of the present invention. For instance, the choke plate fasteners 66 could partially pass through and secure within the choke plates 48, 50 such that adjustment of the fasteners 66 in and out causes a corresponding angular adjustment of the choke plates 48, 50 about the pivot point 60.

Figure 8:
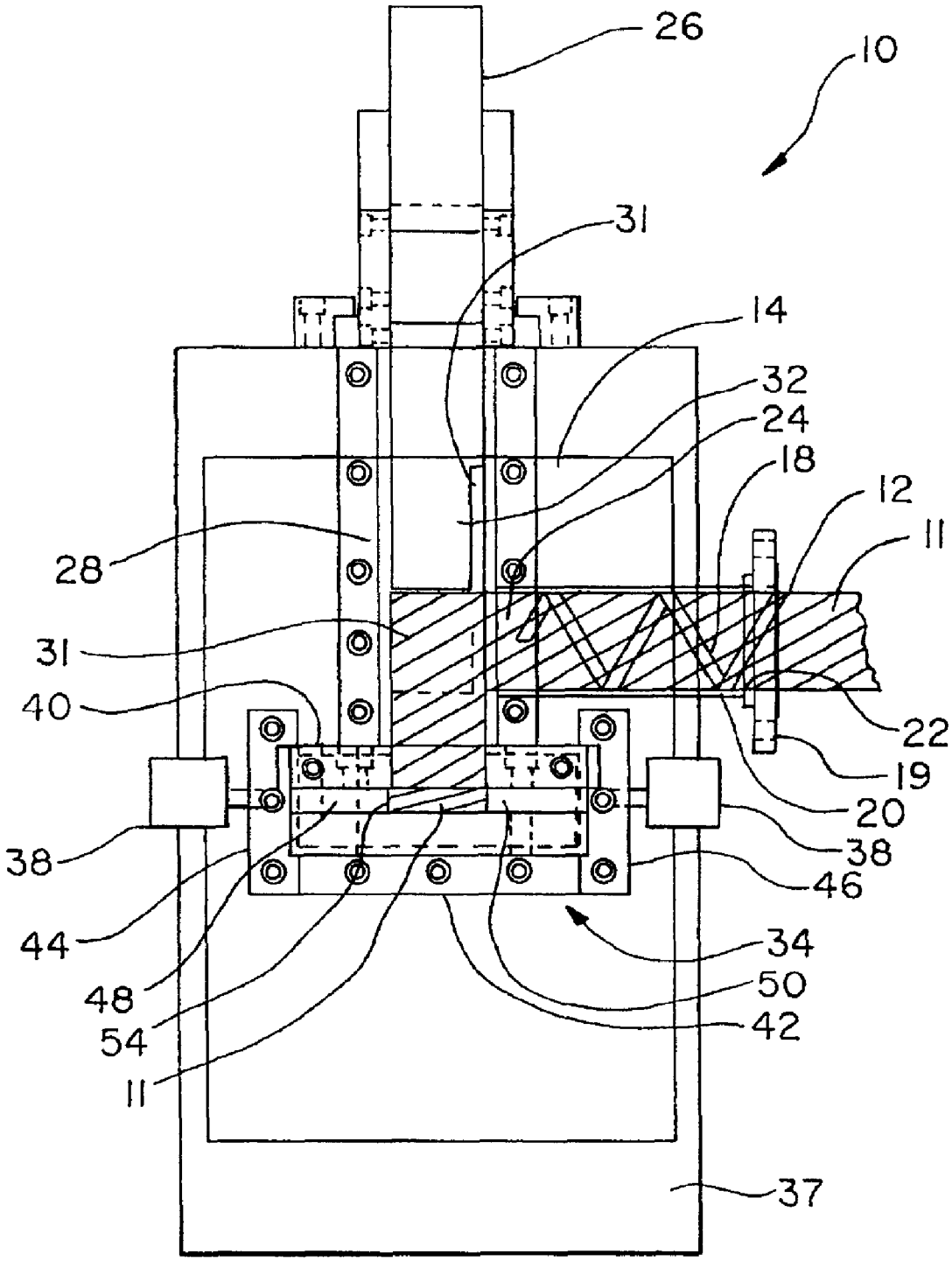
FIG. 8 is a front view of a portion of a material compaction apparatus in accordance with an embodiment of the present invention.
Figure 10:
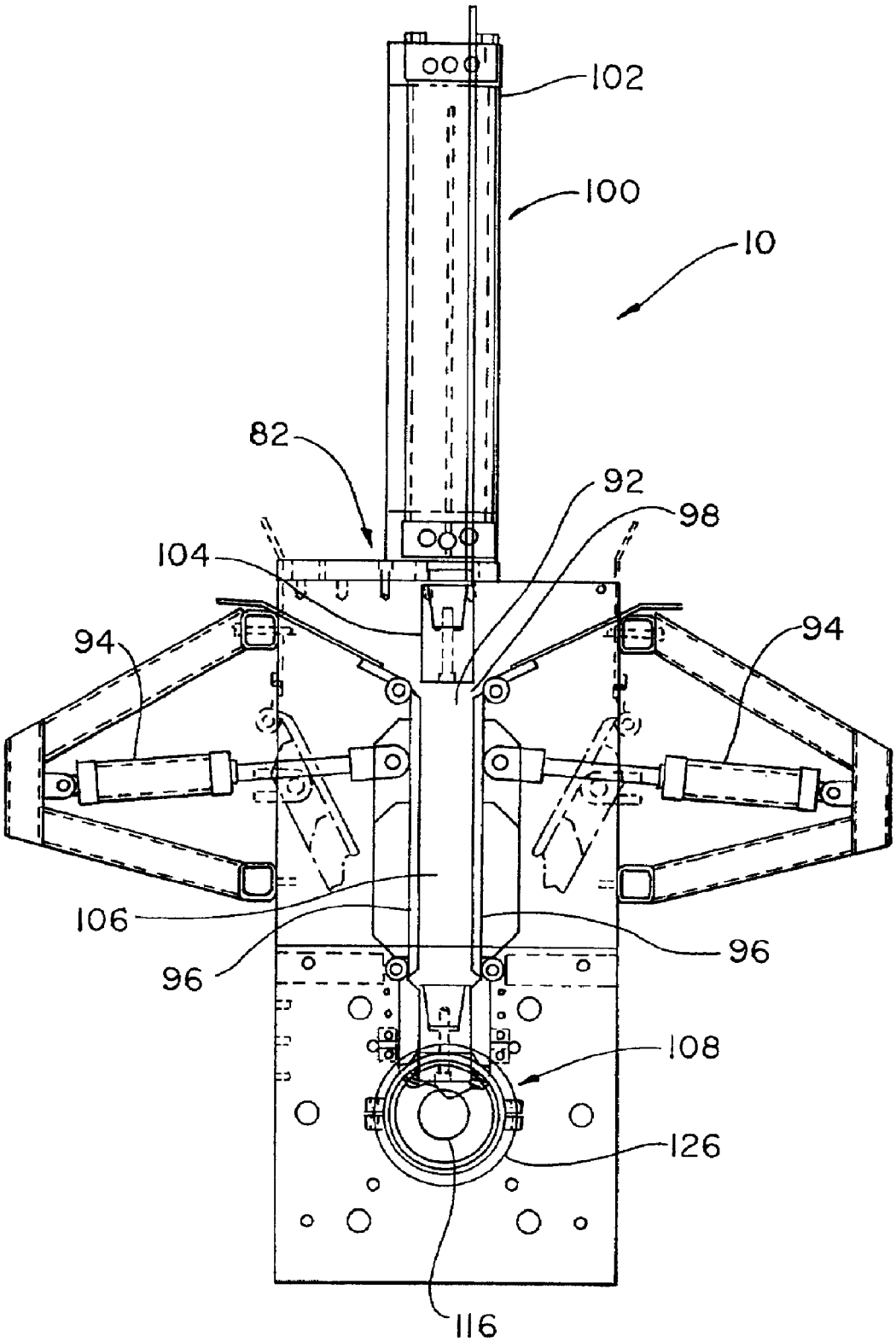
FIG. 10 is a front view of a portion of a material compaction apparatus in accordance with an embodiment of the present invention.

Additionally, as shown if FIG. 8, at least one hydraulic adjustment device 38 can be implemented at the choke tube 34 to facilitate adjustment of the angular orientation of the choke plates 48, 50. With such an embodiment, the at least one hydraulic adjustment device 38 is connected to at least one of the choke plate fasteners 66, or directly to the choke plates 48, 50 through the side plates 44, 46, wherein angular adjustment (pushing or pulling the choke plates at the expelling end) of the choke plates 48, 50 around the pivot point 60 is thereby controlled by a corresponding hydraulic movement of the device 38. Similar devices can also be implemented to facilitate angular adjustment of the choke plates 48, 50.

The final compaction chamber 52 and its inner cavity 53 defined by the various plates of the choke tube 34 have a longitudinal axis generally perpendicular to the axis of the preliminary compaction chamber 28. While the choke tube 34 of the final compaction chamber 52 is generally rectangular in shape for this embodiment of the present invention, it could take on other shapes, such as cylindrical in alternative embodiments, as is further disclosed herein. The cavity 53 of the final compaction chamber 52 includes an entry portion 56 in fluid communication with the perpendicular inner cavity 31 of the preliminary compaction chamber 28. This entry portion 56 is distal the choke tube 34 end of the final compaction chamber 52. Further, the inner cavity 53 of the final compaction chamber 52 includes a discharge port 54 at the expelling end or choke tube 34 end. This discharge port 54 provides a continuously open point of exit for the material 11 out the compactor 10, through the final compaction chamber 52. With angular adjustment around the pivot points 60 of the choke plates 48, 50, the width or distance (i.e., horizontal) of the cavity 53 at this discharge port 54 can be measurably different than the corresponding width or distance at the portions of the cavity 53 proximate the pivot points 60. Preferably, as will be discussed herein, the distance and area of the cavity 53 is adjusted to measurably increase or decrease the taper from the pivot points 60 to the discharge port 54. Similarly, the cavity 53 can be tapered for the area between the entry portion 56 and the pivot points 60. As stated, a reduction in the area is not required to provide for restricting compaction of the material 11 within the cavity 53 since the forceable advancement of the material 11 through the limited confines of the cavity 53 will provide a level of restrictive compacting by itself.

In operation, the rectangular embodiment of the present invention utilizes the taper-adjustable choke tube 34 to perform effective material compaction and liquid separation. Unlike conventional compactors, there is no use of a gate system. In fact, the inner cavity is always open at the discharge port 54, there being no gate as is required in the prior art devices. Compaction and liquid separation is made possible by repeatedly forcing material 11 through the adjustably taperable final compaction chamber 52 and choke tube 34 with repeated hammering blows.

With this rectangular embodiment of the present invention, material 11 is initially channeled into the feed channel 20. The material 11 can be channeled by the auger 18 or other known means directly from and through the bin 17 and into the feed channel 20. Other door and commonly understood feeding systems known to one skilled in the art, and as disclosed herein, could also be implemented to direct material 11 into the preliminary compaction apparatus 14. As material 11 is directed into the entry portion 22, through the feed channel 20, and through to the material exit portion 24, the once loosely grouped chips from the bin 17 are subjected to a light compaction from the forceable movement of the chips through the limited space of the channel 20. As the material 11 fills up the feed channel 20 and is forceably advanced to the exit portion 24, the material 11 is forced into the portion of the inner cavity 31 of the preliminary compaction apparatus 14 in fluid communication with the feed channel 20.

As the lightly compacted material 11, or material group, arrives in the preliminary compaction chamber 28 of the preliminary compaction apparatus 14, after leaving the feed channel 20, it is in placement for the preliminary ramming device 26 (preferably configured for vertical movement) to provide another compaction stage by compacting the material 11 within the preliminary compaction chamber 28, in preparation for movement into the final compaction apparatus 16. The driving means 30 of the ramming device 26 drives the ram 32 in and out of the inner cavity 31 of the preliminary compaction chamber 28. The driving means 30 can be a mechanical device, such as a press, commonly known to one skilled in the art. Alternatively, the driving means 30 could be a hydraulic or like device. The preliminary ramming device 26 generally impacts the group of material 11 in the chamber 28 once before the material 11 is further compressed and advanced into the final compaction apparatus 16 by the final ramming device 36.

Once the preliminary ramming device 26 has further compacted the material 11 in the preliminary compaction chamber 28, the material 11 is in position to be forced into the final compaction apparatus 16 and, specifically, the entry portion 56 of the final compaction chamber 52 for repeated forceable compaction and movement through the inner cavity 53 and the taperable choke tube 34. At this point the material 11 is in the final compaction chamber 52, between the ram 72 and the choke tube 34.

With the advancement of the ram 72 of the final ramming device 36, the material 11 or material group is pushed along and through the inner cavity 53 of the final compaction chamber 52 and the choke tube 34. Eventually, the material 11 enters the choke tube 34 portion of the chamber 52. The timing and movement of the preliminary ramming device 26 and the final ramming device 36 can be configured to be substantially proportional, meaning that they can be set so that as the preliminary ramming device 26 retreats from preliminary compaction the final ramming device 36 advances, and vice versa. Generally, this timed motion results in a 1:1 ratio between the stroke of the preliminary ramming device 26 and the stroke of the final ramming device 36.

An angled gib or slide 74 understood to one skilled in the art is implemented to allow for this proportional corresponding movement of the devices 26, 36, as best shown in FIGS.

3–4. The slide 74 is secured to the final ramming device 36 such that as the final ram 72 advances into and retreats from the chamber 52, the slide 74 follows accordingly. The angled slide 74 engages the preliminary device 26 such that as the slide 74 advances the device 26 follows, or is guided up, the angled surface of the slide 74. Similarly, when the slide 74 retreats with the final device 36, the preliminary device 26 is guided down or lowered along the angled surface of the slide 74. A spring 75 can be included in operable communication with the slide 74 for the retraction and advancement of the device 36. Dashed lines are included to demonstrate the potential movement of the press 37, the final compaction device 36, the slide 74, etc. It is also envisioned that other methods and techniques understood to one skilled in the art for synchronizing such described movement between two opposed devices 26, 36 (hydraulic, mechanical, and the like) can be employed without deviating from the spirit and scope of the present invention.

With each forceable movement of the group of material 11 through the final compaction chamber 52 and out the discharge port 54, it is being subjected to pressure within the cavity 53, and further compaction against leading material 11 or material 11 groups. The pressure or restriction on the material from the pivot points 60 to the discharge port 54 of the choke tube 34 can be adjusted.

Adjustments can be made to the size of the inner cavity 53 proximate the discharge port 54 by angular adjustments to either of the pivotable choke plates 48, 50. In a "nochoke" configuration there is substantially no taper or reduction, or even an increase, in the area of the inner cavity 53 between the pivot points 60 and the discharge port 54. In a "choke" configuration there is a taper, and the taper is variable. A myriad of angles, and angle restrictions, are envisioned for the taper between the pivot pin 60 and the discharge port 54, depending on the particular compaction and liquid separation needs of the user. Material hardness, the power limitations of the final compaction device 36, power consumption concerns, and similar goals and limitations must be considered in making such a determination. This angular adjustment is made by retreating or advancing at least one of the plurality of choke plates 48, 50 at the end proximate the discharge port 54, either manually, hydraulically, or with like means, by adjusting at least one of the fasteners 66. This results in the pivoting of the respective choke plate 48, 50 about the pivot pin 60. Compaction of the material 11 during forceable advancement through to the discharge port 54 can be achieved in a choke or no-choke configuration.

This choking obviates the need for the prior art gate, described above, the ram 72 acting against compressed chips being restrained and further compressed by the preferably decreasing angle along the inner cavity 53 of the chamber 52 and choke tube 34 toward the discharge port 54. Restrictive compaction pressure can even be obtained without tapering the inner cavity to the discharge port 54. This is possible since the grouped or preliminarily compacted material 11 is some size larger in size than that of the area of the inner cavity 53 regardless of any tapering. Simply repeatedly pushing the material through the cavity 53 provides significant compaction and restrictive choking until the material 11 is forced out the open discharge port 54.

If narrowing at the discharge port 54 of the choke tube 34 is desired to provide increased pressure for material compaction and liquid separation, the area or distance of the inner cavity 53 at the discharge port 54 is decreased by pivoting the proximate portions of the designated spaced choke plates 48, 50 closer together. This narrowing of the discharge port 54 of the choke tube 34 results in more pressure on the material 11 forcibly advancing within the chamber 52 as it is pushed through the choke tube 42 by the repetitious advancement of the ram 72. Similarly, a desired reduction in the pressure can be facilitated by pivotably increasing the distance between the spaced choke plates 48, 50 at the discharge port 54. As stated, these adjustments can be made based on many factors.

For demonstrative purposes only, in order to better understand the level of compaction and repetitious compacting hits for which the material 11 is subjected, one mechanical embodiment of the final ramming device 72 can have a stroke of 6 inches, with approximately 42 strokes per minute. Others can advance 25, 50, 100, and like strokes per minute configurations. As a result of the numerous hits upon the material during operation, the material 11 can receive compaction hits for a period of minutes before being ejected from the final compaction apparatus 16 at the discharge port 54. With each compaction hit, a new cube of material 11 is thrust into the final compaction chamber 52 and an existing cube is moved through the inner cavity 53 toward ejection from the choke tube 34 such that cubes are being repetitively compacted against preceding or leading cubes with each hit of the ramming device 36.

The material compactor 10 using a hydraulic source to control and operate the final compaction ramming device 36 can include a pressure control system. The pressure control system can comprise a pressure reading device that reads the pressure being put on the ramming device 36 within the inner cavity 53. Those skilled in the art understand this pressure reading device to embody electrical and hydraulic feedback controls commonly understood and implemented to monitor and control hydraulic pressure such as that implemented for embodiments of the ramming device 36 for the present invention. Pressure readings from the ramming device 36 within the cavity 53 are fed back to the controller or pressure reading device and are used to adjust the pressure being applied to maintain a desired pressure in light of material 11 and liquid changes within the cavity 36. This control system can be implemented to prevent catastrophic damage, or to merely prevent various undesirable results from uncontrolled pressure. The pressure control system can adjust for the pressure being applied in the choke tube 34 by adjusting the hydraulic device 38 to correspondingly adjust the angle of the choke plates 48, 50 about the pivot point. This will in turn vary the compacting pressure/restriction, or funnelized pressure, at the choke tube 34. A known pressure is desired to effect the selected compaction of and liquid separation from a particular kind of material 11.

Cylindrical Embodiment

Referring to FIGS. 10–14, a cylindrical embodiment of a material compactor 10 in accordance with the present invention is shown. This cylindrical material compactor 10 comprises a feed apparatus 80, a preliminary compaction apparatus 82, and a final compaction apparatus 84.

One embodiment of the feed apparatus 80 generally comprises a bin 86, and an auger 88, such that the system feeds material 11 into the preliminary compaction apparatus 82 much the same way described herein for feed apparatus 12 and preliminary compaction apparatus 14 of the rectangular embodiment of the present invention. The auger 88 is generally within a portion of the bin 86 such that material 11 dumped or placed in the bin 86 is moved or advanced by the spiral motion of the auger 88 into the preliminary compaction apparatus 82.

The preliminary compaction apparatus 82 generally comprises a preliminary compaction chamber 92 and a preliminary compaction device 100. This cylindrical embodiment can, like the rectangular embodiment, receive the material 11 from a feed channel included within the feed apparatus 80, or receive material 11 directly into the preliminary compaction chamber 92 to be directed and formed by compaction doors 96. If compaction doors 96 are employed, the doors 96 can form the sides of the generally rectangular compaction chamber 92, for linear or radial movement inward into the cavity 106. Linear doors 96 being substantially parallel to each other, or doors 96 having generally arcuate portions can be employed without deviating from the spirit and scope of the present invention.

The feeding channel provided for by the bin 86 and auger 88 generally terminates into an opening 98 of the preliminary compaction chamber 92. The preliminary compaction chamber 92 is generally rectangular in shape and is surrounded on at least one side by at least one compaction doors 96. It is preferred that two doors 96 are spaced apart to form two sides of the chamber 92. The compaction doors 96 are connected to at least one preliminary driving device 94 for advancing and retracting the doors 96 forward and backward from their original positions in line with the rectangular shape of the preliminary compaction chamber 92. Those skilled in the art will understand the at least one driving device 94 to embody hydraulic, pneumatic, and means of the like. For instance, in one embodiment, the doors 96 will be advanced and retracted with the use of a hydraulic source. The advancement of the doors 96 against the material 11 channeled into the chamber 92 by the feed apparatus 80 provides a measurable level of initial compaction.

Above the opening 98 of the preliminary compaction chamber 92, is the preliminary compaction ramming device 100. This ramming device 100 generally comprises a preliminary compaction driving means 102 for advancing a compaction ramming portion 104 into the preliminary compaction chamber 92. Those skilled in the art will understand the driving means 102 to be advanced by hydraulic, pneumatic, mechanical, or means of the like.

Figure 11:
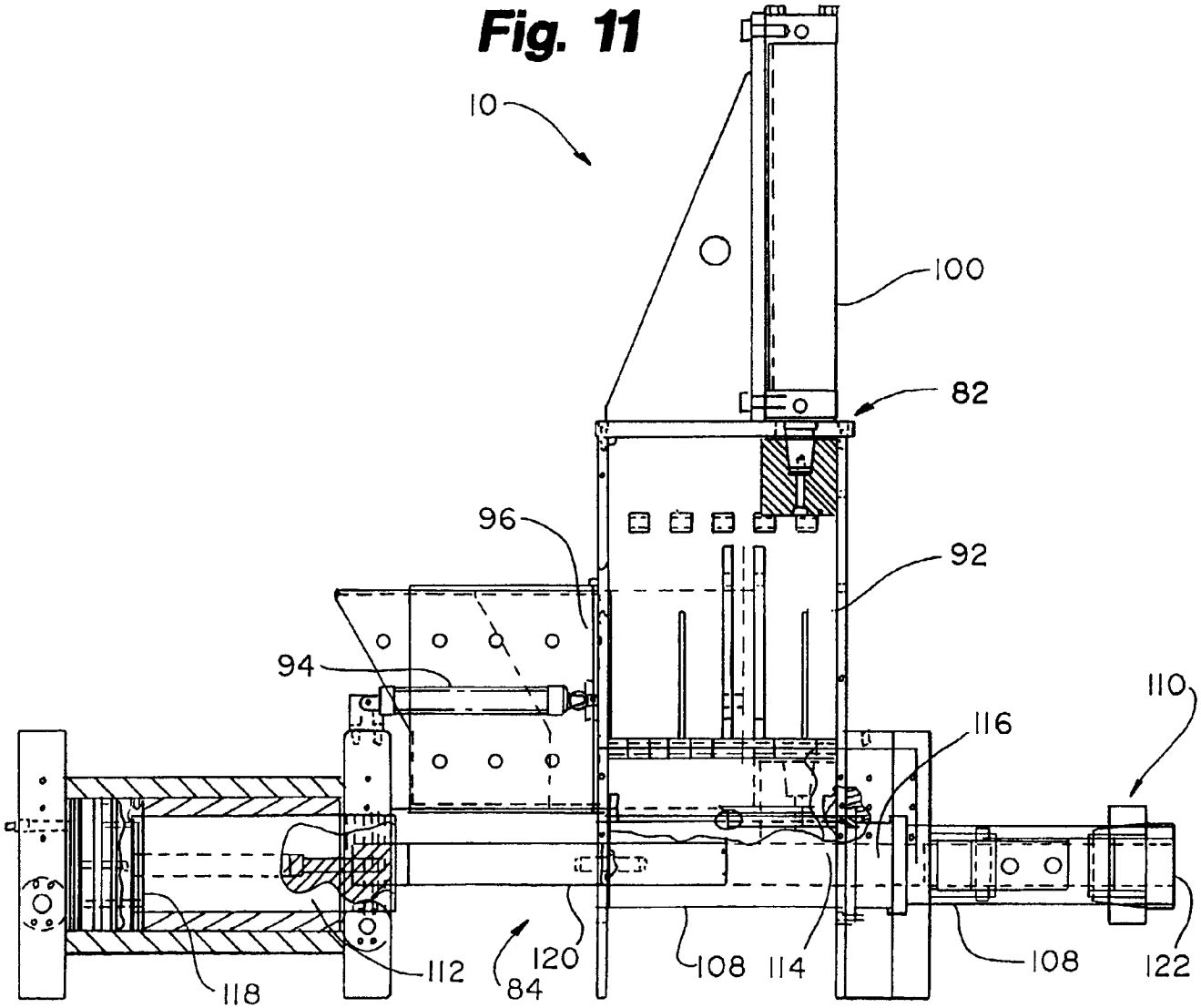
FIG. 11 is a side view of a portion of a material compaction apparatus in accordance with an embodiment of the present invention.

Referring primarily to FIG. 11, the final compaction apparatus 84 generally comprises a final compaction chamber 108 and a final compaction ramming device 112. The final compaction chamber 108 has a longitudinal axis substantially perpendicular to the axis of the preliminary compaction chamber 92. The final compaction chamber 108 is substantially cylindrical in shape and is connected to, and in fluid communication with, the preliminary compaction chamber 92 by an open material entry portion 114. The entry portion 114 opens into a generally cylindrical inner cavity 116 defined in the final compaction chamber 108. This inner cavity 116 begins with the entry portion 114 and ends with a discharge port 122 at a distal choke tube 110 end.

The final ramming device 112 is oriented for axial movement along the interior cavity 116 of the final compaction chamber 108. This ramming device 112 generally comprises a final driving means 118 for advancing and retracting a ram or ramming portion 120 into the final compaction chamber 108. The ramming device 112 can be positionally oriented for horizontal movement, vertical movement, or some angular variation thereof. Those skilled in the art will understand the driving means 118 to include hydraulic, pneumatic, mechanically driven, or means of the like.

Figure 13:
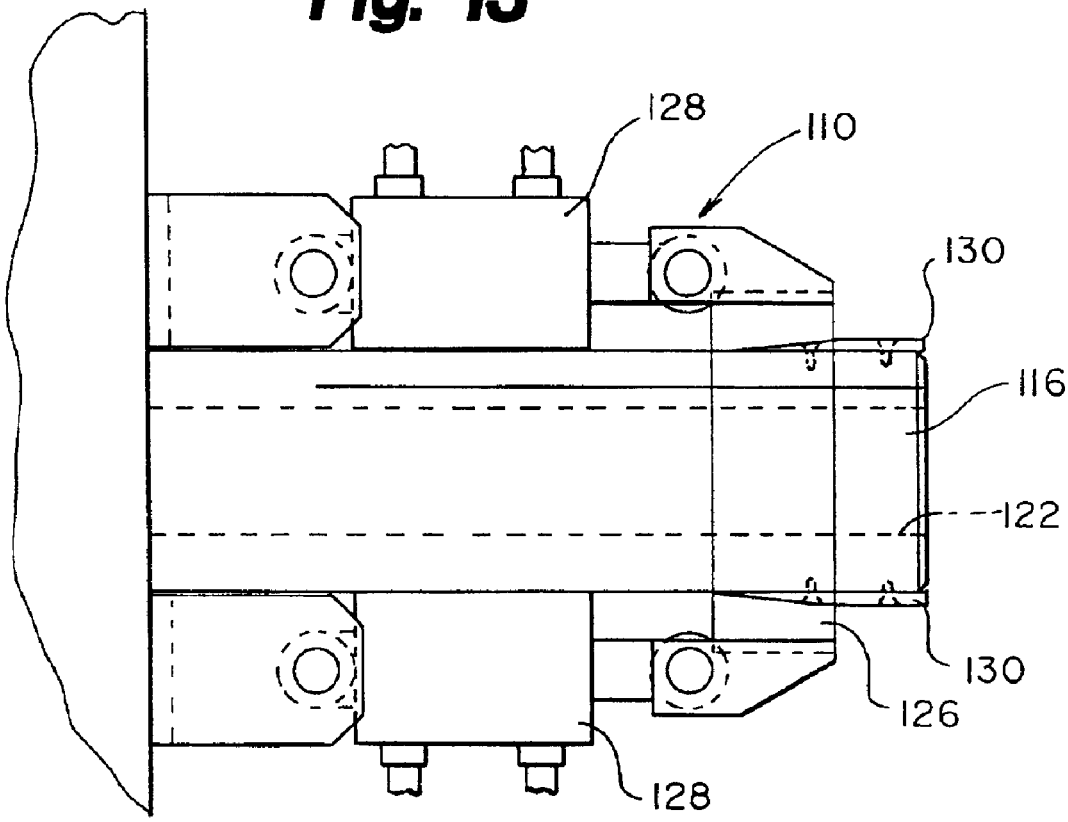
FIG. 13 is a top view of a choke tube in accordance with an embodiment of the present invention.
Figure 12:
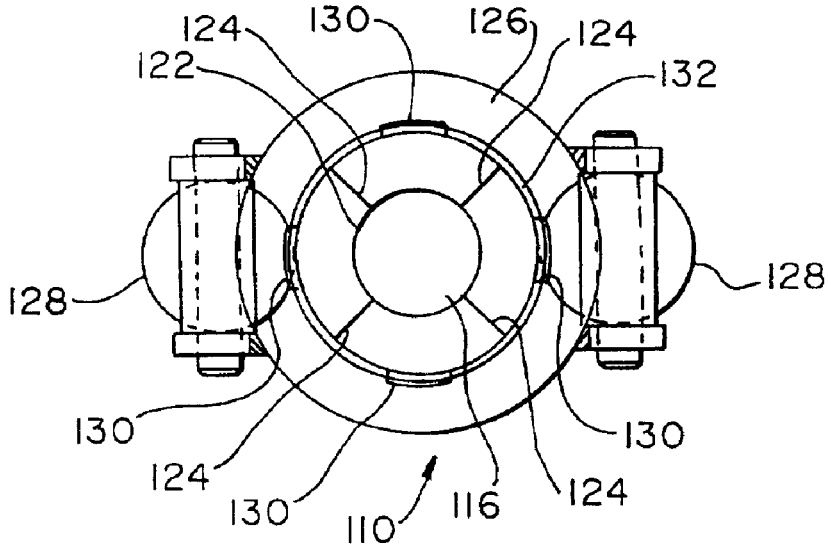
FIG. 12 is a front view of a choke tube in accordance with an embodiment of the present invention.
Figure 14:
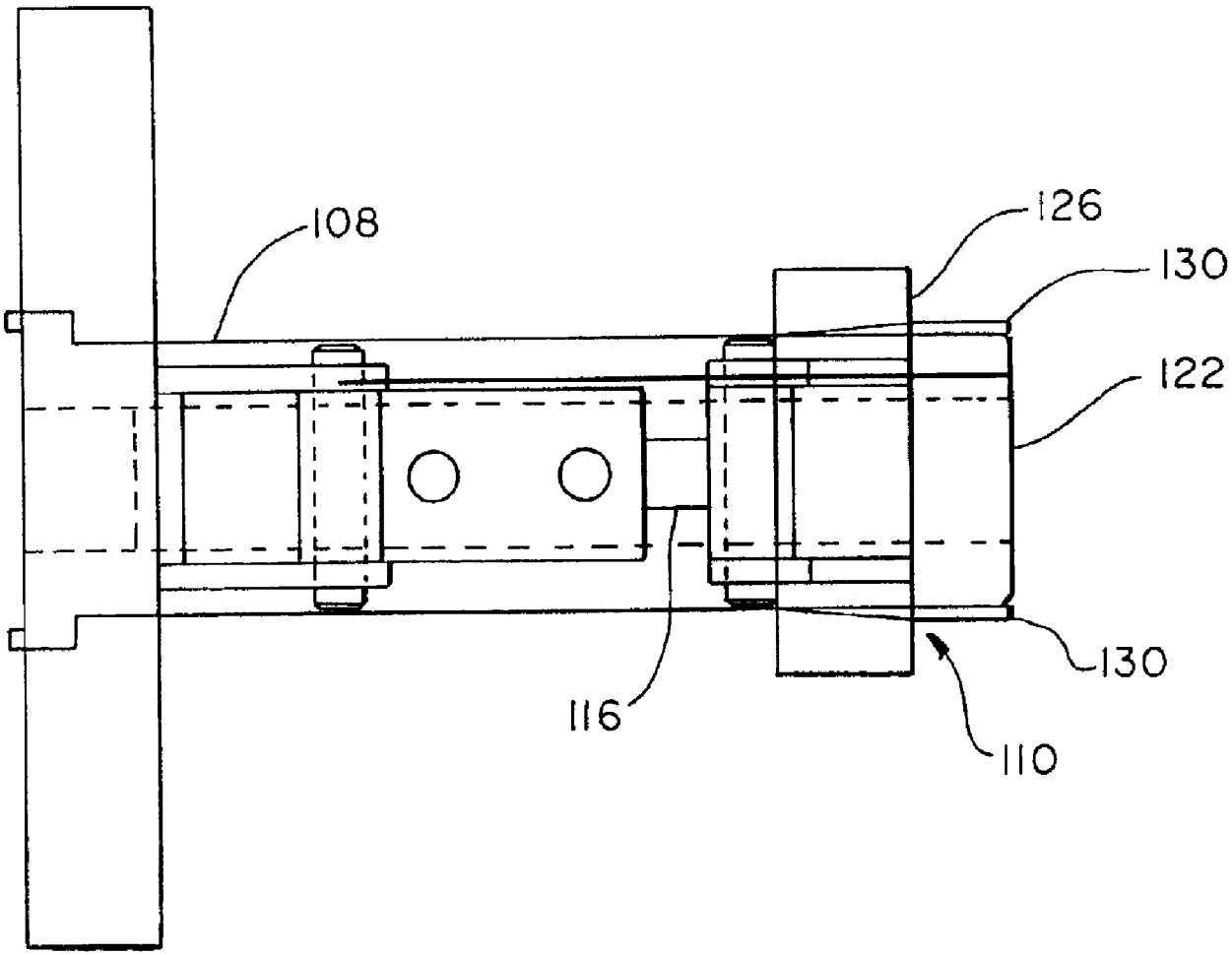
FIG. 14 is a side view of a choke tube in accordance with an embodiment of the present invention.

Referring to FIGS. 11–13, an end region of the final compaction chamber 108 includes the substantially cylindrical choke tube 110. The choke tube 110 is positioned at the end portion of the final compaction chamber 108 distal the ramming device 112. The inner cavity 116 traverses the chamber 108 from the entry portion 114 to the outermost material exit point of the discharge port 122. The choke tube 110 of the chamber 108 generally comprises a plurality of axial slots 124, a choke tube ring 126, a plurality of hydraulic source or means 128, and a plurality of angled surface wedges 130. The axial slots 124 can run along the longitudinal axis of the choke tube 110 and extend through the wall of the choke tube 110 to intersect the peripheral surface to the inner cavity 116 of the chamber 108 and choke tube 110. The slots 124 can be included to facilitate liquid removal from the inner cavity 116. It is envisioned that slots 124 could run along various angles with respect to the choke tube 110 depending on the desired appearance and liquid removal needs. The expelling end or discharge port 122 of the chamber 108 and choke tube 110 remains open to eject compacted material 11.

The choke tube ring 126 is positioned generally at the end of the choke tube 110 proximate the discharge port 122 for circumferential engagement or securement around the choke tube 110. The choke tube ring 126 can further comprise a ring inner cavity 132 between the outer surface of the choke tube 110 and the inner surface of the ring 126. The inner cavity 132 can be tapered or angled from the end aligned with the expelling end or discharge port 122 of the choke tube 110 to the end more proximate the ramming device 112. However, as stated herein, a no-choke configuration will also provide significant restrictive compaction.

The plurality of hydraulic sources 128 or other means are attached to and in communication with the peripheral surface of the choke tube ring 126. The plurality of angled surface wedges 130 are fixed to the peripheral surface of the choke tube 110, decreasing in angle for some distance beginning at the expelling end of the choke tube 110 moving axially along the outside diameter the choke tube 110 toward the material entering end of the choke tube 110.

The material compactor 10 using a hydraulic source to control and operate the final compaction ramming device 112 can include a pressure control system. The pressure control system can comprise a pressure reading device that reads the pressure being put on the ramming device 112 or the ramming portion 120 within the inner cavity 116. Those skilled in the art understand this pressure reading device to embody electrical and hydraulic feedback controls commonly understood and implemented to monitor and control hydraulic pressure such as that implemented for embodiments of the ramming device 112 for the present invention.

In operation, the cylindrical embodiment of the present invention utilizes the taper-adjustable choke tube 110 to perform more effective material 11 compaction and liquid separation. Unlike conventional compactors, there is no use of a gate system. In fact, the inner cavity remains open at the discharge port 122, there being no gate as is required in the prior art compactors. Compaction and liquid separation is made possible by repeatedly forcing material 11 through the adjustably taperable final compaction chamber 108 and choke tube 110.

With this embodiment of the present invention, material 11 is initially channeled into the preliminary compaction apparatus 84 from the feed apparatus 80. The material 11 is generally channeled by the auger 88 from the bin 86. In those embodiments employing compactor doors 96, the material 11 can be fed from the auger 88, manual feeding, or with like means, into the opening 98 of the preliminary compaction apparatus 84 proximate the doors 96. The doors are advantageous for initially compacting material 11 of odd shapes, sizes, and those constructed of unique or hard materials. For some material it may be necessary to merely feed or channel the material directly into the chamber 92 using at least one of the doors 96 since transporting the material with the auger 88 and bin 86 would prove to be undesirable or even impossible.

If compaction doors 96 are employed, once the material 11 or group of material 11 is loaded into the preliminary compaction chamber 82, the compaction doors 96 advance inward (radially or linearly, depending on the particular configuration), compressing the material 11 into a generally rectangular shape. Following this first compaction stage, the preliminary ramming device 100, preferably vertically positioned, further compresses the material 11 and drives it into the final compaction chamber 108 of the final compaction apparatus 84. As disclosed for the rectangular embodiment of the present invention, synchronization of the preliminary compaction device 100 with the final compaction device 112 can be achieved in the manner described herein.

Once the subject material 11 or group of material 11 has been forced into the final compaction chamber 108, it is in position to be forced along the inner cavity 116 to the choke tube 110 for final compaction and separation. At this point the material 11 is in between the final ramming device 112 and the discharge port 122 end of the choke tube 110.

The final ramming device 112, preferably configured for horizontal movement, advances, pushing the material 11 into the inner cavity 116 of the choke tube 110. To adjust the tapered angle or internal area of the inner cavity 116 between the ramming device 112 and the discharge port 122, adjustments can be made by moving the choke tube ring 126 toward, or away from, the discharge port 122 end of the choke tube 110. These adjustment can be made automatically or manually. This movement of the choke tube ring 126 along the surface of the choke tube 110 moves the angled inner cavity 132 of the choke tube ring 126 along the angled surface wedges 130. This in turn adjusts the restriction, or funnelizing, pressure on the discharge port 122 end of the choke tube 110 by varying the area of the inner cavity 116 proximate the port 122. If the choke tube ring 126 is moved closer to the discharge port 122 of the choke tube 110 up the increasing angle of the wedges 130), the discharge port 122 is narrowed such that the area of the inner cavity 116 at the discharge port 122 is measurably smaller than the area distal the choke tube ring 126. This narrowing of the discharge port 122 results in more pressure on the material 11 within the cavity 116 of the choke tube 110 as it is forced through the cavity 116 before exiting at the discharge port 122. Similarly, the choke tube ring 126 can be moved away from the discharge port 122 end of the choke tube 110, down the decreasing angle of the wedges 130, to reduce the pressure on the material 11 forceably engaging the inner cavity 116 of the choke tube 110. Pressure can even be obtained without inwardly tapering the inner cavity to the discharge port 122 (i.e., parallel or even outward-tapering inner cavity 116 wall dimensions at the discharge port 122). This is possible since the grouped or preliminarily compacted material is some size larger in size than that of the area of the inner cavity 116. Simply repeatedly pushing the material through the cavity 116 provides significant compaction and pressure choking until the material is forced out the open discharge port 122. Adjustments to this pressure can be made based on many factors, including but not limited to, material hardness, costs, and liquid separation needs.

The choke tube ring 126 can be continuously adjusted to narrow and expand the discharge port 122 or expelling end of the choke tube 110. This allows the inner cavity 116 at the choke tube 42 to subject the material 11 to compacting restriction or pressure while remaining open to eject compacted material 11 out the discharge port 122. A plug of compacted material 11 will be ejected automatically from the port 122. This continuous constriction adjustment makes the need for a gate system unnecessary.

A great deal of the liquid separation occurs when the material 11 is compacted and pressed through the expelling end of the choke tube 110. Consequently, the plurality of axial slots 124 provide a means for channeling the excess liquid such that it can escape the material 11 and the inner cavity 116.

If the pressure control system is employed with a hydraulic embodiment of the final compaction device 112, feedback data is provided to a controller for monitoring and controlling the pressure being applied to the material 11 by the final ramming device 112 within the cavity 116. Pressure readings from the ramming device 112 are fed back to the controller or pressure reading device and are used to adjust the pressure being applied to maintain a desired pressure in light of material 11 and liquid changes within the cavity 116, to prevent catastrophic damage, or to merely prevent various undesirable results from uncontrolled pressure. The pressure control system adjusts, either manually or automatically, for the pressure being applied in the choke tube 110 by moving the choke tube ring 126 forward or backward along the surface of the expelling end of the choke tube 110 to respectively increase and decrease the amount of constriction on the choke tube 110. Varying such constriction acts to increase or decrease the amount of restriction or pressure (changes in the area of the inner cavity 116 approaching the discharge port 122) required to advance the ramming device 112 against the material 11 in the inner cavity 116. A known pressure is desired to effect the selected compaction of and liquid separation from a particular kind of material 11.

The present invention may be embodied in other specific forms without departing from the spirit of the essential attributes thereof; therefore, the illustrated embodiments should be considered in all respects as illustrative and not restrictive.

What is claimed is:

1. A method of compacting a comminuted metallic material and substantially separating liquid from the material in a material compaction apparatus, comprising the steps of:

directing comminuted metallic material into the material compaction apparatus by a feed apparatus having a bin and an auger;

performing a preliminary level of compaction on the comminuted metallic material in preparation for final compaction through a taperable compaction chamber having first and second ends;

repeatedly advancing a compaction ram through a continuously open inner cavity of the compaction chamber such that the comminuted metallic material in the chamber is continuously advanced and subjected to compacting resistance against at least two opposing adjustable plates defining at least a part of the inner cavity and a continuously open discharge port proximate the second end, wherein the at least two opposing plates are selectively adjustable by an external force application proximate thereto and the comminuted metallic material is expelled out of the chamber through the continuously open discharge port; and channeling liquid expelled from the comminuted metallic material under compaction from the compaction chamber by at least one channel extending from the inner cavity of the compaction chamber to an exterior thereof.

2. The method of claim 1, wherein the compaction chamber and the inner cavity are substantially rectangular in shape.

3. The method of claim 2, wherein the opposing plates are rotatable such that resistance on the comminuted metallic material within the inner cavity is variable by selectively adjusting the rotatable plates proximate the discharge port about a pivot point to adjust the area of the inner cavity from the pivot point to the discharge port.

* * * * *